US005372383A

United States Patent [19]

Kubierschky

[11] Patent Number: 5,372,383

[45] Date of Patent: Dec. 13, 1994

[54] STEERABLE CHASSIS ARRANGEMENT FOR ROLLER SKIS

[76] Inventor: Stefan Kubierschky, Twedt Buschau, Germany

[21] Appl. No.: 640,376

[22] PCT Filed: Jul. 31, 1989

[86] PCT No.: PCT/EP89/00896

§ 371 Date: Apr. 1, 1991

§ 102(e) Date: Apr. 1, 1991

[87] PCT Pub. No.: WO90/01359

PCT Pub. Date: Feb. 22, 1990

[30] Foreign Application Priority Data

| | | | |
|---|---|---|---|
| Aug. 1, 1988 | [EP] | European Pat. Off. | 88112473.9 |
| Nov. 14, 1988 | [EP] | European Pat. Off. | 88118977.3 |
| Apr. 13, 1989 | [EP] | European Pat. Off. | 89106636.7 |

[51] Int. Cl.[5] ..... A63C 17/06

[52] U.S. Cl. ..... 280/842; 280/11.23; 280/11.28

[58] Field of Search ..... 280/11.22, 11.23, 842, 280/11.27, 11.28, 11.19

[56] References Cited

U.S. PATENT DOCUMENTS

| | | | |
|---|---|---|---|
| 1,034,649 | 8/1912 | Rice | 280/11.23 |
| 2,204,280 | 6/1940 | Meister | 280/11.23 |
| 3,389,922 | 6/1968 | Eastin | 280/11.23 X |
| 4,132,425 | 1/1979 | Lehner et al. | 280/11.23 |
| 4,373,736 | 2/1983 | Stumbaugh | 280/11.23 |
| 4,392,659 | 7/1983 | Yoshimoto | 280/11.23 |

*Primary Examiner*—Richard M. Camby
*Assistant Examiner*—Michael Mar
*Attorney, Agent, or Firm*—Townsend and Townsend Khourie and Crew

[57] ABSTRACT

A steerable chassis arrangement for roller skis comprises a chassis and an axle assembly having an axle shaft and hollow tube. A rotatable wheel is mounted to the axle assembly such that the wheel defines a vertical datum and a vertical plane when the wheel is on a normal straight-ahead direction. The axle tube is disposed with an are defined by the outer surface of the rotatable wheel. The axle tube is pivotally coupled to the axle shaft so that it pivots about an access that is inclined with respect to the vertical datum and disposed in the vertical plane of the wheel.

50 Claims, 14 Drawing Sheets

I
II
10
11
12
13
14
15
16
17
18
19
20
24
27
28
29
31
32
33
34
35
36
37
38
39
45

11,12
19
21
22
23
25
26
31
35
41
42
43
44

STEERABLE CHASSIS ARRANGEMENT FOR ROLLER SKIS

BACKGROUND OF THE INVENTION

The present invention relates to a chassis arrangement having a steerable element, in particular a wheel, steerable on tilting of said chassis relative to the ground, and to a steerable element for use in a chassis.

A chassis arrangement having a steerable element which is steerable on tilting of the chassis relative to the ground is known from international application No. WO 88/04565.

In this known chassis arrangement the steerable element is mounted on the chassis via first and second links. The first link is pivotally supported at one end on said chassis and supports a substantially horizontally disposed axle for said steerable element, and the second link is pivotable about an axis disposed parallel or oblique to the ground and substantially intersecting the contact area, where, in the straight ahead position of the steerable element, the latter contacts the ground. In addition means is provided between said first and second links defining a substantially vertical axis which substantially intersects the first said axis at said contact area, and the steerable element is swivellable about this vertical axis to effect steering on pivotal movement of said second link about the first said axis under the moment created by the ground pressure and its moment arm about the first said axis resulting from tilting of the chassis.

The known chassis (international application publication No. WO 88/04565) is particularly envisaged for use with a roller skate, a skateboard, a roller ski, a roller bob, a snow scooter or the like, i.e. with devices where steering is produced as a result of displacement of the user's weight resulting in tilting of the chassis. Since the steering element can have different forms, for example a wheel in a roller skate or skateboard, a caterpillar type device in a dry ski, or a ski, slid or mow device in a snow scooter, this term will be understood whereever it is used in the specification, to cover any of the relevant items, depending on the particular construction of the device involved.

The aforementioned international application publication No. WO 88/04565 describes in detail the possible scope of application of such a chassis and the fact that it is applicable to one or two track vehicles, for example to a so-called in-line skate having two or more wheels arranged in a line one behind the other, or to a roller skate of a more conventional appearance with pairs of wheels arranged on each axle. The thoughts expressed in this respect in the aforementioned international application concerning the wide applicability of the chassis design are equally relevant here.

The kinematics of a chassis of the above described kind are such that frictional forces acting sideways on the steerable element or wheel have substantially no effect on the steering, since they have no moment arm about either of the relevant axes, i.e. the first said axis or the vertical axis. In straightahead running the reaction force at the contact patch also has substantially no moment arm about either of the said axes, since it acts substantially vertically through the vertical steering axis. Thus the reaction force also has no relevant moment arm which could induce a steering moment. If, on the other hand, the user displaces his weight so that the chassis is tilted relative to the ground, the reaction force of the ground is moved sideways so that it now has a moment arm about the first said axis. This results in a small pivotal movement of the specially cranked second link about the first said axis so that the end of the second link adjacent the steering element moves sideways. This in turn rotates the first link about its point of mounting on the chassis, resulting in rotation of the steerable element or wheel about the vertical axis and a steering movement to the right or left depending on the direction of tilting of the chassis. Tilting of the chassis to the left results in steering to the left and vice versa. The amplitude of the steering movement is related to the amplitude of the tilting movement.

A problem arises with a chassis of the kind known from international application No. WO 88/04565 in as much as the connection between the first and second links defining the vertical axis is positioned above the steerable element or wheel and requires a certain amount of space. It is however known from experience of roller skates and the like that the lower the chassis can be made the easier it is for the user to skate thereon. Even a reduction in height of as little as 1 cm has a substantial influence on the behaviour of the skate.

It is accordingly a first object of the present invention to so further modify the chassis design of the above-mentioned kind that an extremely compact chassis is obtained, in particular a chassis having an overall height which is reduced to a minimum, with the task of manufacturing the chassis being kept straightforward and with the cost of the individual components and of the chassis being minimised. Moreover, the chassis should be easy to assembly and reliable in use.

It is a further object of the present invention to provide an improved steerable element for use in a chassis, in particular a steerable wheel which can be substituted for existing non-steerable wheel assemblies in in-line skates and the like to convert the same to more readily steerable skates, in particular skates capable of describing circular arcs.

A yet further object of the present invention is to provide a wheel and axle assembly which could be mounted on a supermarket trolley to make the same more easily steerable.

SUMMARY OF THE INVENTION

In order to satisfy the first said object the present invention is characterised in that said means provided between said first and second links defining said substantially vertical axis is disposed in the center region of said steerable element, in the region of said horizontally disposed axle.

In this way the means does not take up any space about the steerable element and the chassis can be lowered until it is only just clear of the steerable element.

A particularly preferred embodiment is characterised in that said means defining a substantially vertical axis comprises an axle tube supported by said first link with said steerable element being mounted on said axle tube; an axle shaft supported by said second link and extending with clearance through said axle tube; and pin means defining said substantially vertical axis and extending between said axle tube and said axle shaft.

Here a particularly compact arrangement is obtained since the pin means defining the substantially vertical axis is wholly disposed within the center of the wheel, or between a pair of wheels if two wheels are mounted on said axle tube. This is a protected position where the pin means can readily be protected against the ingress of abrasive elements or water or the like, which would otherwise result in deterioration of the chassis.

In practice the pin means preferably comprises two pointed gimbal pins engaging in respective conical recesses in the surface of said axle shaft. IX such an arrangement the pins are characterised in that said gimbal pins are threaded at the outside and engage in screw threads in said axle tube.

This is a particularly simple embodiment and the ability to screw the pins into the axle tube enables them to be finely adjusted during assembly. They can be held in their adjusted position either by the use of a metal bonding adhesive (Loctite (registered trademark)), or by a lock nut, or deforming the threads, or by some other similar means.

This arrangement is not only simple to manufacture and to adjust, it also has the advantage that the axle shaft can be made thickest at the portion where the pins engage, thus ensuring that the axle shaft is strong at the position of maximum bending moment. In addition the axle shaft can be made more slender towards its ends, thus providing an ample clearance between the axle tube and the axle rod to permit steering of the wheel.

Moreover, the axle tube itself can be thickened in the region where the pins engage to provide shoulders adjacent the thickened region against which the bearings for the wheel can be mounted. Thus, the thickened portion serves two purposes, namely to support the bearings in the axial direction of the axle tube and to provide a support for the threaded pins.

Thus, a particularly preferred embodiment of the invention is characterised in that said steerable element comprises a single wheel mounted on said axle tube by two axially spaced apart bearings, especially rolling element bearings; and in that said pins are disposed between said bearings.

With an arrangement of this kind the first and second links can readily be formed as forks and can be secured to the chassis.

In an alternative embodiment the first and second links take the form of single arms.

An alternative way of realising the vertical steering axis is provided by an arrangement which is characterised in that said first and second links are forks each having a head end mounted at said chassis and fork ends positioned adjacent one another at said axle; in that said steerable element comprises a wheel; in that said means defining a substantially vertical axis comprises partly spherical surfaces at said fork ends of said second link and mating partly spherical surfaces provided either at the fork ends of said first link or at the ends of said axle whereby relative sliding movement can take place at said spherical surfaces about said vertical axis. In this arrangement the axle preferably extends through generally horizontal slots or recesses in the fork ends of the second link so that the steering axis is kept vertical.

Although the pin means defining said substantially vertical axis is preferably located between an axle tube and an axle shaft as described above it is also possible for the pin means to comprise a pin disposed to one side of the steerable element, which is preferably a wheel, with said pin being inclined so that said substantially vertical axis intersects the contact area between the steerable element and the ground.

The pin and the vertical axis defined thereby will normally be disposed in a vertical plane perpendicular to the straightahead direction of the steerable element but inclined in that plane towards the ground contact area or patch.

The pin itself may be an integral part of an axle for the steerable element (wheel) or it may be a separate pin. In a particularly preferred arrangement the pin is supported at two spaced apart locations on said axle and at two spaced apart locations on said second link.

In a typical roller skate two said chassis will be mounted facing in opposite directions to the bottom of one shoe or boot. The chassis arrangement of the present invention has the advantage that it is entirely reversible so that only one chassis arrangement needs to be manufactured and can be used as desired for the front or rear wheel.

In order to satisfy both the first object of the present invention and also the further object recited above a steerable wheel in accordance with the present teaching (i.e. comprising a hollow axle tube supporting the wheel, an axle shaft disposed within said axle tube and means extending from said axle tube to said axle shaft and defining an axis permitting limited relative pivotal deflection or steering movement between said axle and said axle tube, with said axis being directed substantially towards the region of contact between said steerable element and the ground) can also be substituted for the steered wheels in the two-wheeled roller skate of Swiss patent 603 198, for the steered wheels in the chassis of the above-mentioned international application WO 88/04565 and for the steered wheels in the chassis of the further international application No. WO 88/04564.

Such a substitution would lead to a higher degree of compactness, lower constructional height and improved performance.

With such a steerable wheel resilient means is preferably provided between the axle tube and the axle shaft to provide a restoring moment to the normal straightahead steering position. Such resilient means could for example comprise an elastomeric compound injected into the clearances between the axle tube and the axle shaft or it could comprise metallic spring elements disposed between the axle tube and the axle shaft.

For effecting the substitution described above the axis directed towards the region of contact between the steerable element and the ground will normally be a vertical axis.

A most important, surprising and advantageous further development of the present invention can however be achieved if the axis is an inclined axis. This permits the construction of a chassis arrangement.

In general the inclined axis will be disposed in a vertical plane containing the normal straightahead direction of said steerable wheel but will be inclined so that it points forwardly and downwardly through the contact region.

A steerable wheel of this kind has the particularly surprising advantage that it can be substituted for the normal wheels of an in-line skate to produce an improved skate capable of permitting the user to skate in circular arcs. In general the steerable wheel will be a wheel mounted via bearings on the axle tube. It is possible for the axle shaft to be mounted rigidly in the chassis, steering resulting solely from the freedom of movement provided for the steerable element by the disposition of the inclined axis.

Alternatively the axle shaft could for example be mounted in a fork which is pivotally mounted on the chassis about a horizontal axis (in the normal straightahead position), e.g. in the manner of a leading or trailing fork suspension for a motor cycle. With an arrangement of this kind springing is possible to improve ground contact and ride comfort. Such springs will then act between the fixed part of the chassis and the leading or trailing fork supporting the axle shaft of the steerable element.

Whilst the use of a forked element to hold the axle shaft is preferred it is also quite possible to support the axle shaft at only one end by means of a suitably dimensioned leading or trailing link. Indeed the steerable element may also be fixed rigidly to the chassis via a single post connecting one end of the axle shaft to the chassis.

In a further embodiment the notional point of intersection of the inclined axis with said contact region is disposed in front of the centre of said contact region, at least in the non-worn state of said steerable element.

This arrangement improves the straight line stability of the steerable element, and of a chassis on which it is mounted and also compensates for wear of the steerable element. This wear compensation aspect can be important if the steerable element is a wheel provided with a solid tire in the manner of a roller skate, since such solid tires are subjected to considerable wear in use resulting in a substantial change in diameter of the steerable element. In some circumstances advantages can be gained by displacing the notional point of intersection of the inclined axis with said contact region behind the centre of said contact region.

In a further, particularly compact embodiment the wheel is mounted on the axle tube via at least one bearing, with the axle tube comprising an inner race of said bearing. In this way a separate axle tube can be saved as well as the complication of mounting the inner race of the bearing, or inner races of the bearings, on the axle tube. In this special embodiment the inner race of the bearing would typically be provided with a nose, containing the recesses for the gimbal pins defining the inclined axis.

The invention will now be described in further detail by way of example only and with reference to the drawings.

DESCRIPTION OF THE PREFERRED EMBODIMENTS

Figure 1:
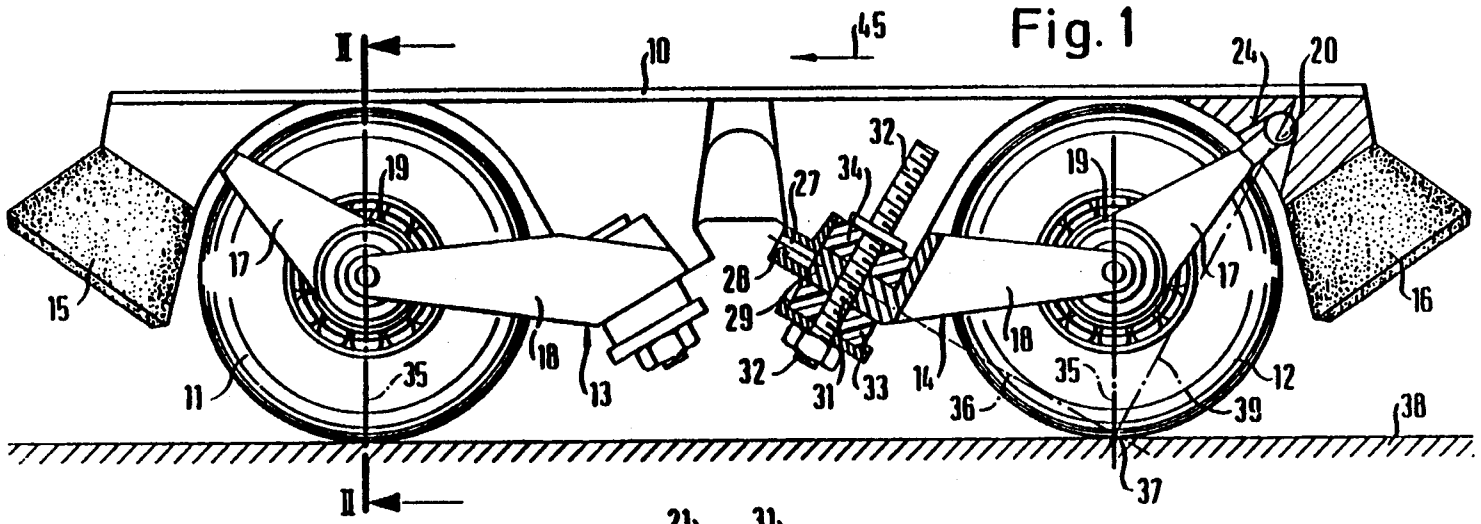
FIG. 1 a schematic side view of a roller skate chassis having front and rear wheels, with the mounting points for the rear wheel being shown partly in section to illustrate the arrangement, FIG. 2 a section on the line II—II of FIG. 1 showing a first embodiment of the means defining the vertical axis, FIG. 3 a cross-section similar to that of FIG. 2 but of a modified embodiment showing the preferred means for defining the vertical axis, FIG. 4 a partly sectioned view of the axle shaft of the embodiment of FIG. 3 as seen in a vertical section, FIG. 5 a view of the axle shaft of the embodiment of FIG. 3 as seen from above, FIG. 6 a partly sectioned view of the axle tube of the embodiment of FIG. 3, FIG. 7 a view of the securing nut and washer arrangement used in FIG. 3 to secure the fork ends of the second link to the axle rod, FIG. 8 a view of one of the two identical gimbal pins used with the embodiment of FIG. 3, FIG. 9 a view of a sealing shield used with the wheel bearings of the embodiment of FIG. 3, FIG. 10 a view of a locking washer used with the nut of FIG. 7, FIG. 11 a view similar to that of FIG. 5 but of a modified embodiment of the axle shaft, FIG. 12 a view in the direction of the arrow XII in FIG. 11 showing the axle shaft mounted within an axle tube, FIG. 13 a perspective view of an alternative chassis arrangement in accordance with the present invention, FIG. 14 a section through a steerable wheel when used in a chassis arrangement similar to that of FIG. 13, FIG. 15 a section through a steerable wheel in which the axle shaft is supported on a single link, FIG. 16 a view in the direction of the arrow XVI of FIG. 15 showing details of the suspension of the steerable wheel.

Referring now to FIG. 1 of the enclosed drawings there can be seen a chassis 10 for a roller skate having two single wheels 11 and 12 at its front and rear ends respectively. The chassis arrangement 13 for the wheel 11 is identical to the chassis arrangement 14 for the wheel 12, the two chassis arrangements are merely reversed in the way that they are attached to the basic chassis 10. The basic chassis 10 in the drawing is a single piece it could, however, also be formed in two pieces which are movable relative to one another in the longitudinal direction of the roller skate to facilitate adaptation to difference shoe sizes. Buffers 15 and 16 are provided at the extreme front and rear ends of the roller skate. The reason why the rear chassis arrangement 14 is reversed relative to the front chassis arrangement 13 is simply to ensure that when the skater wishes to turn to the left the front wheel 11 steers to the left while the rear wheel 12 turns to the right. This is necessary to ensure that the axes of rotation of the two wheels 11 and 12 intersect in the desired manner at the center of the arc the skater is turning around.

As can be seen each of the chassis arrangements 13, 14 comprises a first link 17 and a second link 18. The first link 17 has the shape of a fork with the fork ends 19, which can readily be seen in FIG. 2, being connected to an axle tube 21 on which the wheel 11 or 12 is mounted via rolling element bearings 22, 23. Each first link 17 also has a head end provided with a spherical bearing head 20 which engages in a partly spherical recess 24 in the chassis. The recess 24 diverges towards the associated wheel so that there is room for angular movement of the first link 17 about the center of the spherical bearing head 20.

The second links 18 also have a generally forked shape with their forked ends 25 being connected to opposite ends of an axle shaft 26 disposed within the associated axle tube 21. The head end of each of the second links 18 has a respective spigot 27 which engages in a generally cylindrical recess 28 in the chassis 10, the recesses 28 may be lined with a bearing bush or the like as desired. Furthermore, the head of each second link 18 has a flattened portion 29 with a central aperture 31 through which a securing screw 32 passes with clearance. Rubber bushes 33 and 34 are interposed on each side of the flattened portion 29 so that the link is resiliently mounted here.

Figure 2:
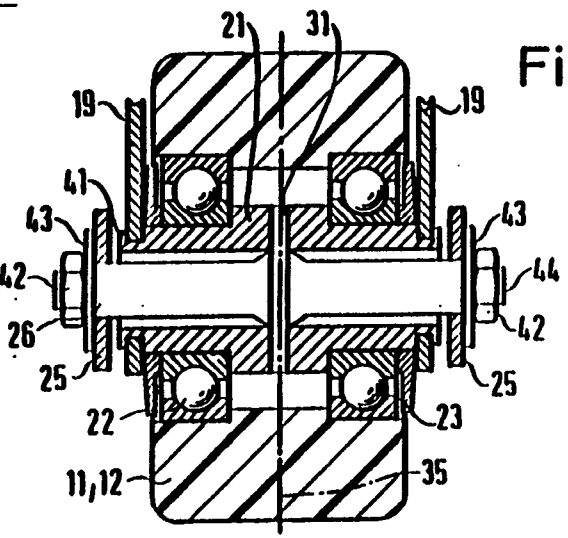

It will be noted from FIG. 2 that a pin 31 extends in a vertical direction through the axle tube and the axle shaft and thus defines a vertical axis 35 about which the wheel can rotate for steering movements. The spigot 27 defines an axis 36 which, when projected, passes through the ground contact patch 37 between the wheel 12 and the ground 38. Since the spherical head 20 is rotatable in all directions about its center the first link 17 is also rotatable about an axis 39 which when projected also extends through the contact patch 37 and intersects with the vertical axis 35 and the first said axis 36.

Various details are also apparent from the drawings of FIG. 2. For example it can be seen that the axle tube is thickened between the two bearings 22, 23 to provide an abutment shoulder for the inner races of these bearings. The fork ends 19 of the first link 17 engage on annular shoulders of the axle tube, and these end shoulders are turned over, i.e. permanently deformed at 41 to permanently retain the ends of the first links on the axle tube. As an alternative one could also use a circlip to retain the fork ends 19 on the axle tube. The fork ends of the second links are retained on the axle shaft by means of a nut and washer assembly 42, 43, with the nut 42 being screwed onto a screw thread 44 at the end of the axle tube. The washer 43 is secured against rotation by means of a flat on the end of the axle shaft and a correspondingly shaped recess in the washer.

In operation, if the user wishes to turn to the left, he leans to the left and the shift in the contact region 37 (out of the plane of the drawing of FIG. I for both wheels in FIG. 1) results, so far as the front wheel 11 is concerned, in a rotation of the second link 18 about its spigot 27, i.e. about the axis 36 (not shown for the front wheel of FIG. 1). This results in movement of the fork ends 25 of the frontmost second link 18 to the right as seen in the longitudinal direction of the skate shown by arrow 45 in FIG. 1 (since the front ends lie above the axis 36). The cooperation between the second link 18 and the first link 17 which is pivotally secured at its front end to the chassis results in steering of the front wheel to the left. Because the suspension of the rear wheel 12 is reversed relative to that of FIG. 1 this wheel steers to the right in the desired manner. The rubber bushes 33, 34 provide a restoring force, i.e. a restoring moment about the axis 36, which tends to restore the wheels to the straight position.

Figure 3:
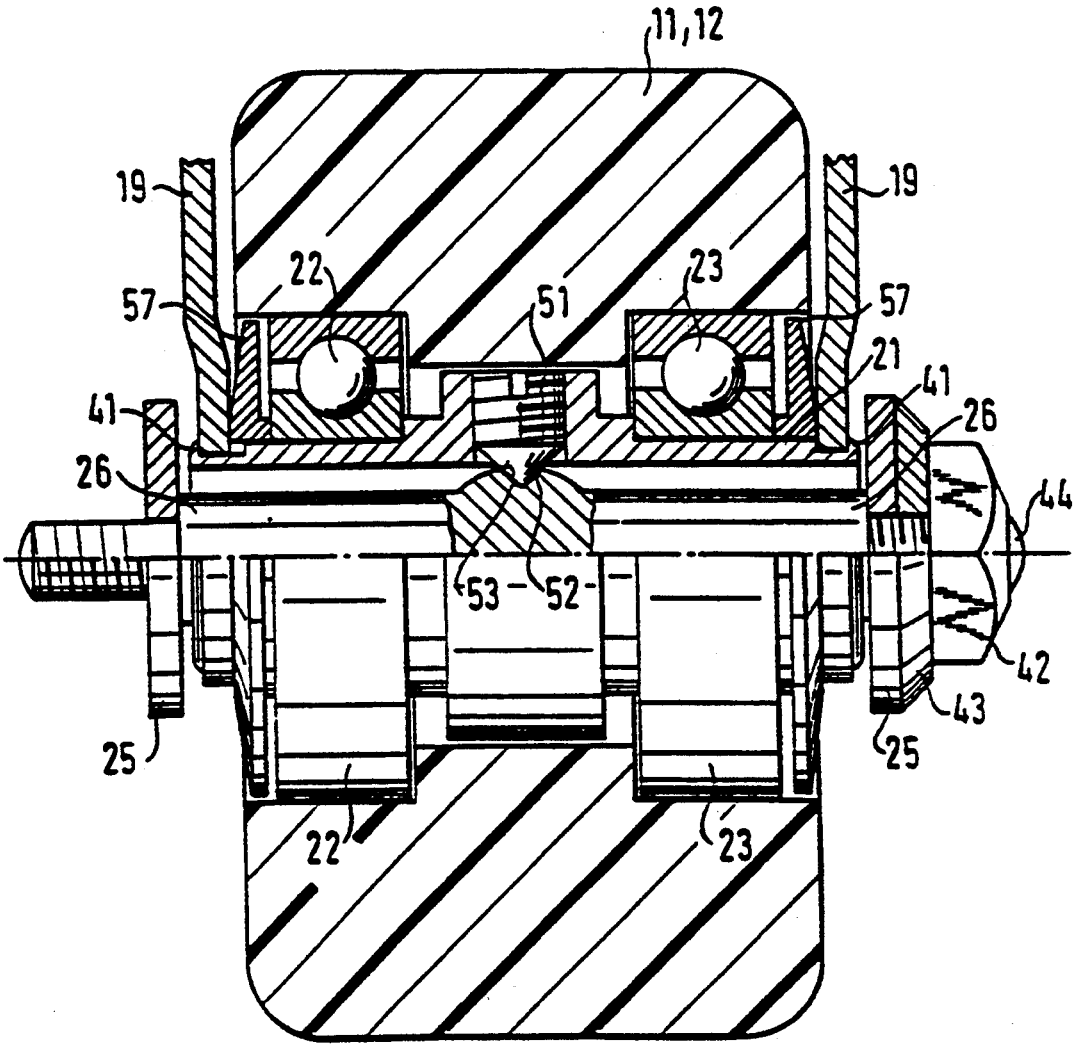
Figure 9:
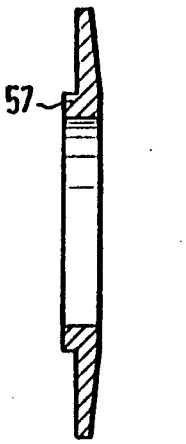
Figure 8:
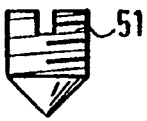
Figure 10:
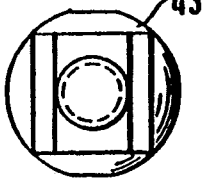
Figure 7:
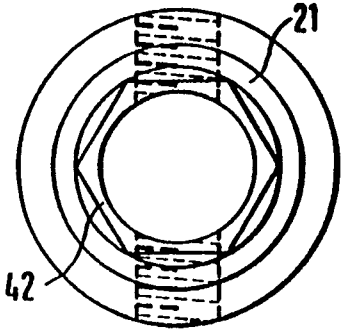
Figure 4:
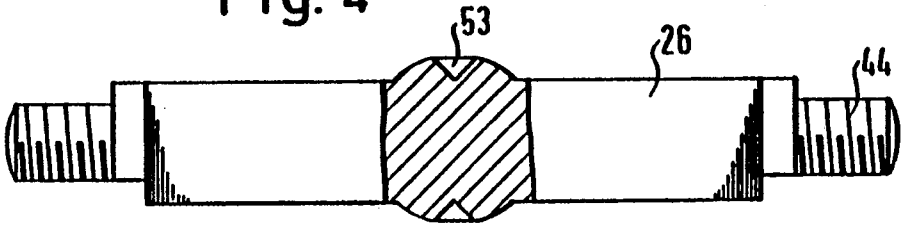

An alternative embodiment is shown in FIG. 3 which is basically very similar to the embodiment of FIG. 2 which is why the same reference numeral have been used for corresponding parts. The pin means is however replaced in the embodiment of FIG. 3 by two oppositely disposed gimbal pins 51 (only the upper pin 51 is shown in FIG. 3) which have hardened conical ends 52 which engage in correspondingly formed conical recesses 53 in the center of the axle shaft 26.

It will be noted that shields 57 are disposed between the fork ends of the first links 17 and the associated inner races of the bearings 22, 23 and serve to protect the bearings against the ingress of contamination. Once again it can be seen that the ends of the axle tube are turned over the fork ends of the first link to secure them at 41. The mounting of the fork ends of the second link 18 is effected in the same manner in the embodiment of FIG. 3 as in FIG. 2. The individual pans, namely the axle tube 21, the axle rod 26, the gimbal pins 51, the bearing shield 57, the securing nut 42, and the locking washer 43 which fits on a flat at the end of the axle rod 26 can be seen in the scale 2 to 1 in FIGS. 4 to 10 of the drawings.

Figure 5:
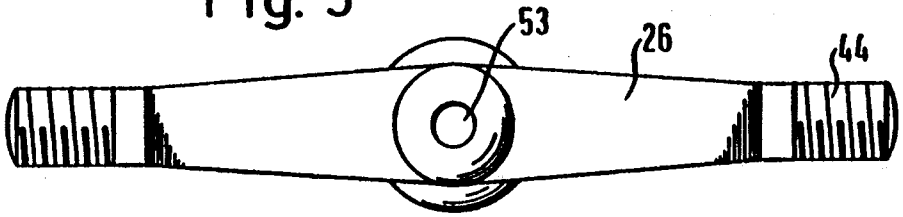
Figure 6:
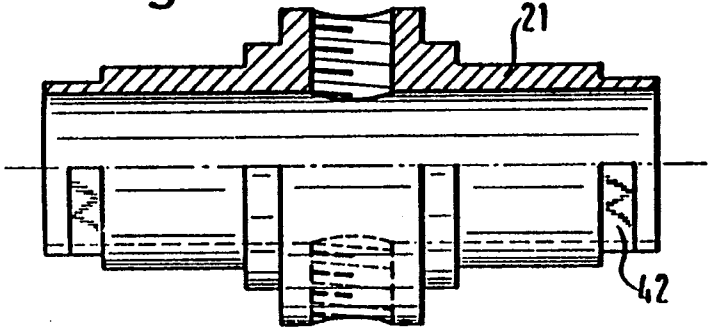
Figure 11:
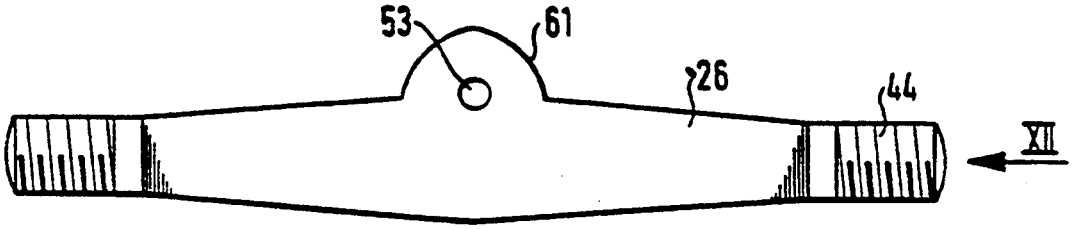
Figure 12:
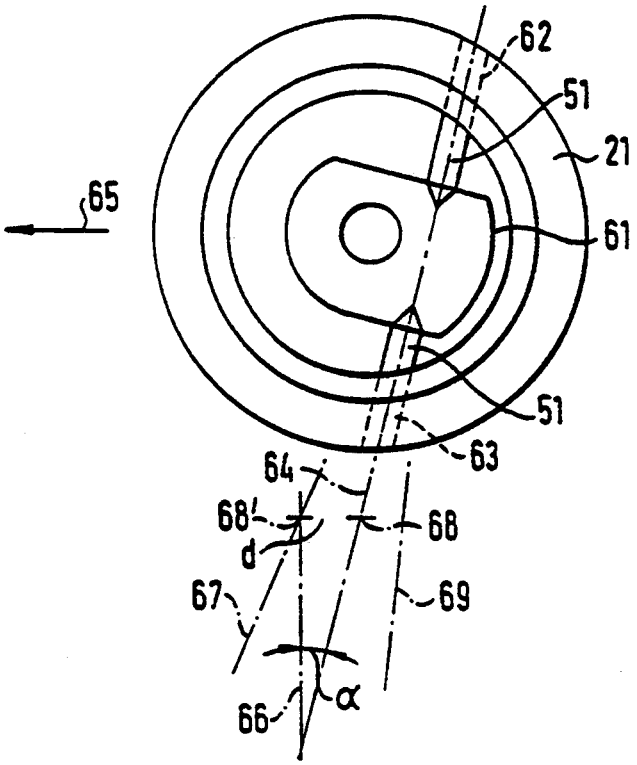

Turning now to FIGS. 11 and 12 there are shown modified versions of the axle shaft and axle tube previously described, for example with reference to FIGS. 5 and 6. Parts in FIGS. 11 and 12 and in the later figures having counter-pans in the earlier figures will be designated with the same reference numerals.

The axle shaft 26 of FIG. 11 is asymmetrically constructed in that it has a nose 61 which projects to one side of the axle shaft 26. The purpose of this nose is to provide space for the recess 53 for the gimbal pin to be moved away from the centreline of the axle shaft. In similar manner the axle tube 21 (FIG. 12) is provided with asymmetically disposed threaded bores 62 and 63 for receiving the threaded gimbal pins 51. It will be noted from FIG. 12 that the inclined axis 64 defined by the gimbal pins is disposed in a vertical plane which contains the straightahead direction 65 of the steerable element. Thus the inclined axis 64 subtends an angle $\alpha$ with the true vertical 66. The broken line 67 indicates that the axis can also be positioned so that it does not pass through the centre 68 of the ground contact patch, as does the axis 66, but instead intersects the ground at a point 68' located at a distance d in front of the centre of the ground contact patch 68. This arrangement tends to improve the self-centering of the wheel and also compensates for wear in the solid tire which leads conceptually to vertically upward movement of the centre 68 of the ground contact patch. The broken line 69 shows that the axis can also be placed so that tt intersects the ground behind the centre 68 of the ground contact patch.

Although not shown in FIG. 12 the solid tire, which may be of rubber or polyurethane, for example, is mounted on the axle via one or more bearings, in similar manner to that shown in FIG. 2.

Figure 15:
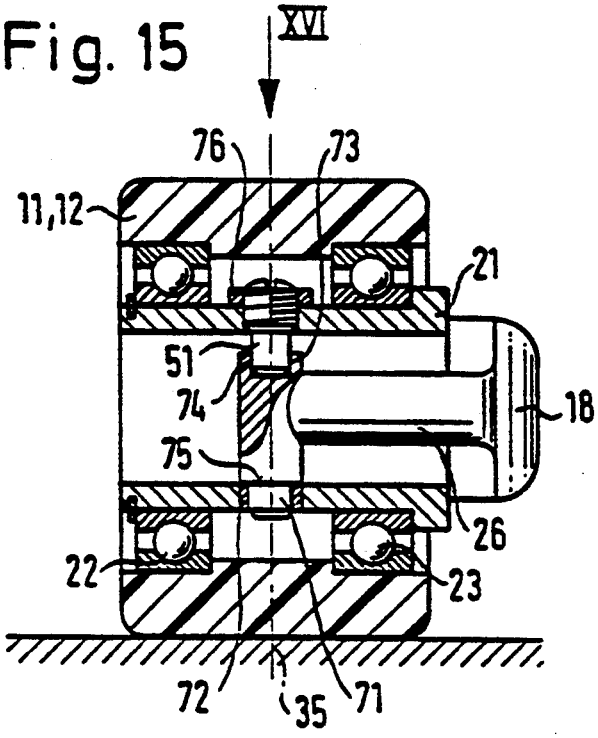
Figure 16:
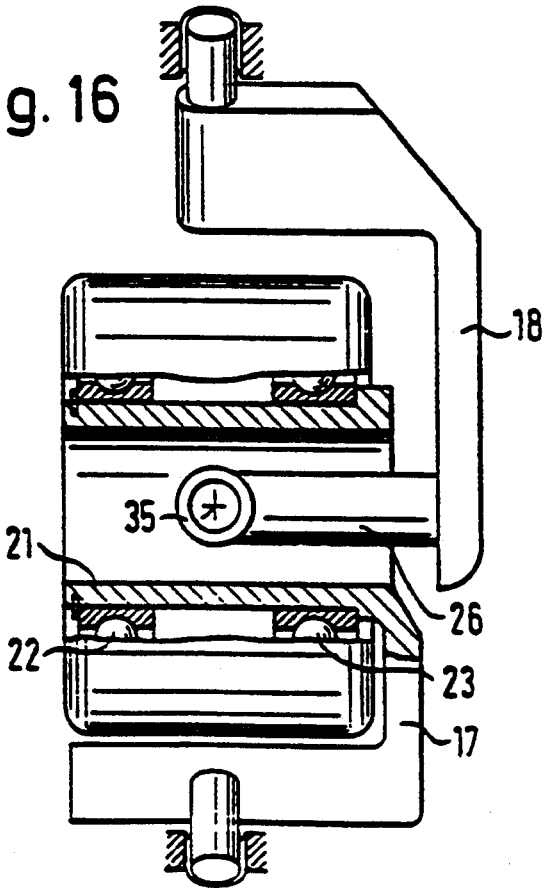

FIG. 15 shows an embodiment in which the axle shaft is supported at one end only. Here the axle shaft 26 is formed integrally with the second link 18 and the axle tube 21 is formed integrally with the first link 17 as can be seen more clearly from the plan view of FIG. 16. In this embodiment the vertical axis 35 is realised in a slightly different manner. The end of the axle shaft 26 remote from the second link 18 is namely provided with a spigot 71 which engages in a cylindrical bearing sleeve 72 mounted in the axle shaft 21, with the central longitudinal axis of the cylindrical bearing sleeve 72 being coincident with the vertical axis 35. In addition to the spigot 71 there is provided a single gimbal pin 51 which is ,again radially directed through the tubular portion of the axle sleeve 21 into an appropriately shaped recess 73 in the end of the axle shaft 26 remote from the link 18. The recess 73 is in this embodiment a cylindrical recess and contains a cup-shaped liner 74, the cylindrical walls of which are disposed coaxial to the vertical axis 35 and the bottom portion of which forms an abutment for the gimbal pin 51. In practice the gimbal pin 51 is adjusted so that there is essentially no free play in the vertical direction between the end of the axle shaft 26 and the wheel. Thrust loads are transmitted to the axle shaft 26 from the wheel via the horizontal flange 75 of the cylindrical liner 72. A lock nut 76 is provided to secure the gimbal pin 51 in position.

Figure 17:
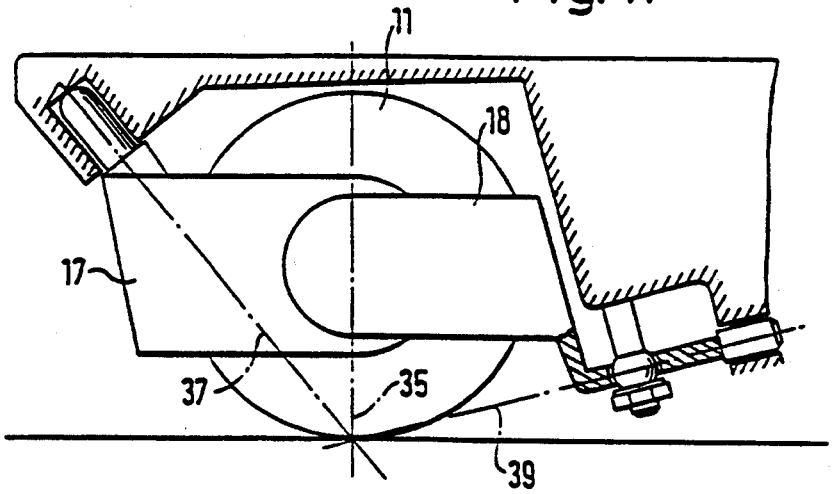
FIG. 17 a schematic view of a chassis similar to that of FIG. 1 but with a slightly modified link arrangement, FIG. 18 a view showing a chassis arrangement similar to that of the Swiss patent 603 198 but incorporating a steerable wheel in accordance with the present invention, and FIG. 19 a schematic view of a chassis similar to that of international application No. WO 88/04564 but incorporating the steerable wheel in accordance with the present invention.
Figure 18:
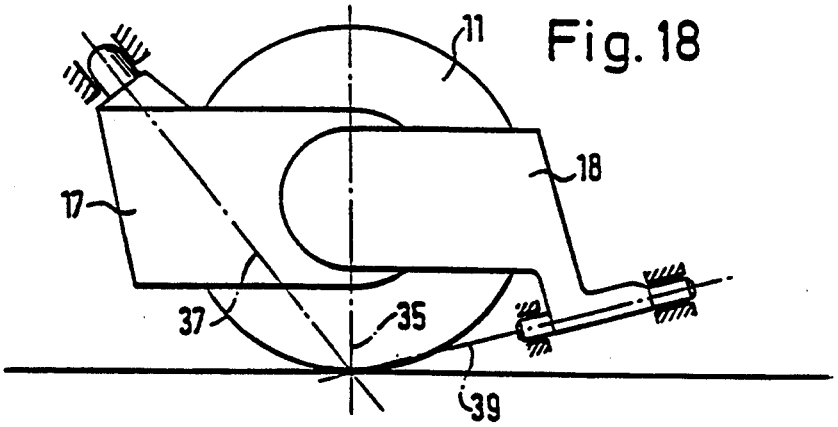
Figure 19:
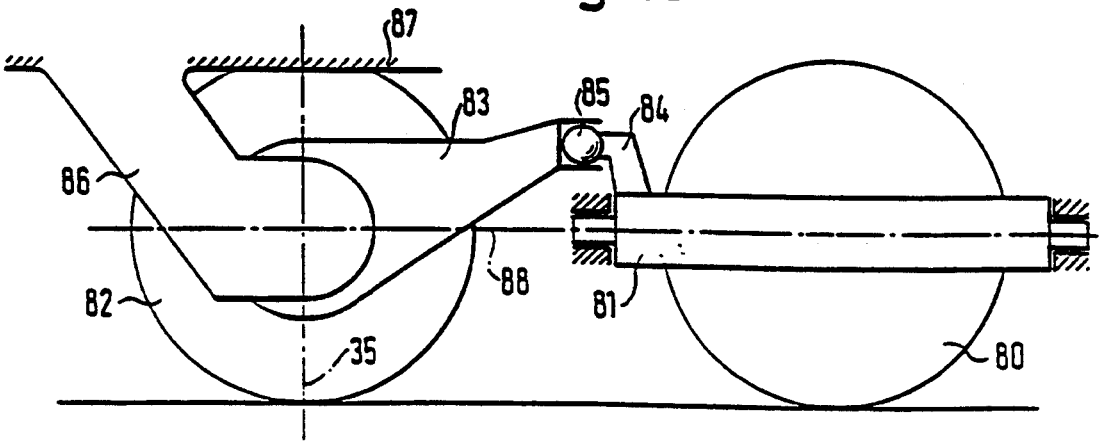

FIGS. 17, 18 and 19 show how a steerable element in the form of a wheel and having a vertical steering axis 35 (for example in accordance with the embodiment of FIGS. 2 to 10) can be incorporated into various chassis designs. FIG. 17 shows an embodiment which is in fact closely similar to FIG. 1 of the present drawings but in which the rubber bushes 33, 34 are no longer used since these bushes are now incorporated as a resilient elastomeric composition in the hollow axle tube surrounding the axle shaft 26. Once again it can be seen that the basic geometry of FIG. 1 is retained with the three intersecting axes 39, 35 and 37.

FIG. 18 shows that the application of the steerable wheel with the internally defined vertical axis 35 to a chassis which is otherwise constructed in similar manner to that shown in Swiss patent 603 198. A comparison of that prior art specification with the presently shown embodiment will however reveal that the chassis of the FIG. 18 embodiment can be made substantially lower since there is no need for suspension structure to be provided above the wheel.

FIG. 19 shows an embodiment which resembles the chassis shown in international application, publication No. WO 88/04564 in which tilting of the chassis, as sensed by laterally disposed wheels 80 (only one of which is shown in FIG. 17), produces turning of a horizontally mounted axle 81 in the clockwise or anti-clockwise direction (X). This in turn produces steering movement of a front wheel 82. In this embodiment the axle tube is connected to a first link 83 which cooperates at its rear end with a ball-shaped member 85 at the end of a radial arm 84 of the shaft 81. The axle shaft is fixedly connected via a pair of forks 86 to the base member 87 of the chassis. It will be appreciated that rotation of the shaft 81 about its horizontal fore and aft axis 88 results in steering movement of the first link 83 such that the end which engages the ball member 85 moves in a direction perpendicular to the plane of the drawing depending on the direction of rotation of the shaft 81. This movement produces steering movement of the wheel about the vertical axis 35 as indicated by the double arrow y.

While the steerable element is preferably a wheel it could also be used with other forms of steerable element.

Figure 13:
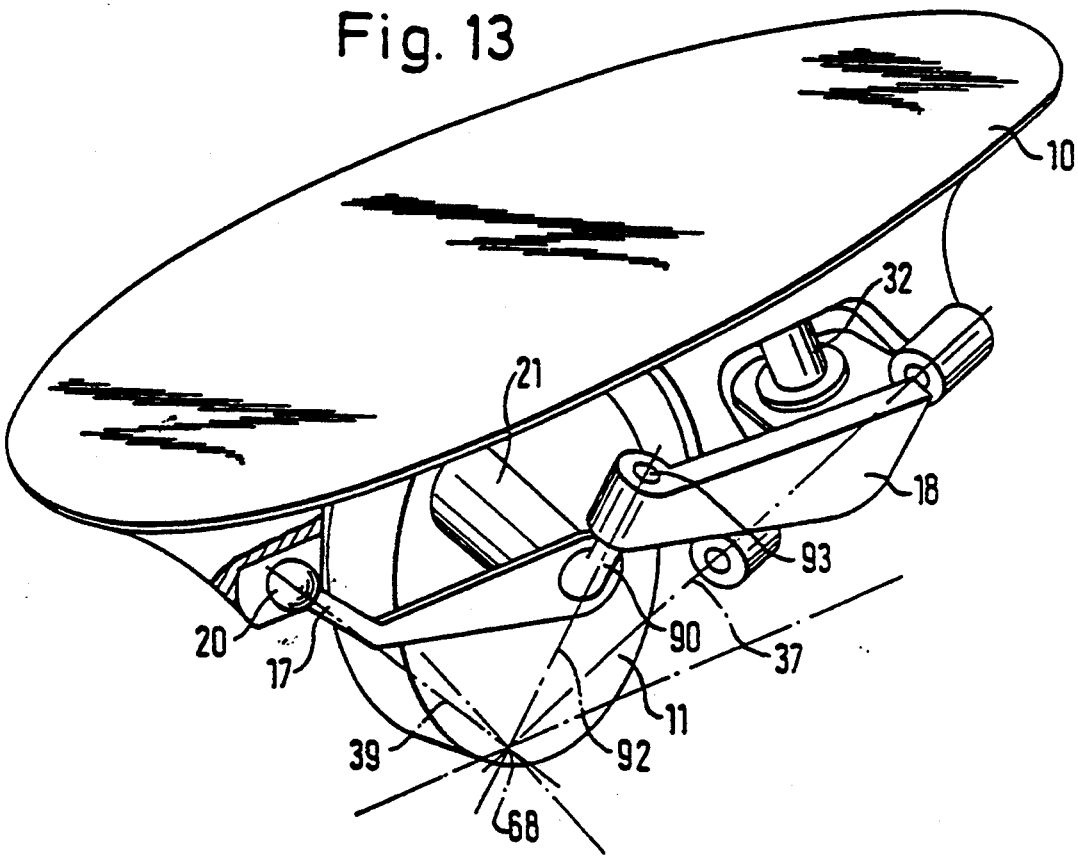
Figure 14:
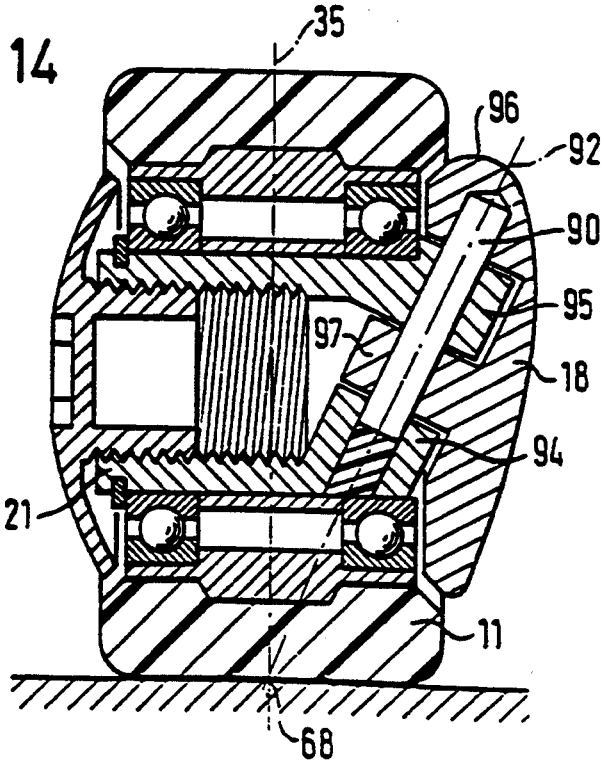

FIGS. 13 and 14 show two further possible embodiments. Since the geometry of these embodiments is basically similar to that of FIG. 1 the same reference numerals have been used to designate the individual parts and the description of parts common to the embodiment of FIG. 1 will not be given.

First of all it will be noted that the wheel 11 of the FIG. 13 embodiment is supported by links provided only at one side of the chassis 10. The first link is integral with a bar or tube 21 forming an axle for the wheel 11 and it will be understood that the wheel 11 is supported on the axle via one or more bearings. On the axle 21 adjacent to the first link 17 there is provided an integral pin 90 which defines an inclined axis 92 which intersects the other two axes 39 and 37 at the centre 8 of the ground contact region. The pin 90 is slidingly rotatably received in a cylindrical bearing 93 formed in the wheel end of the second link 18. In this case it can be said that the means provided between the first and second links defining said substantially vertical axis is disposed in the centre region of the steerable element, in the region of the horizontally disposed axle 21.

FIG. 14 shows a slightly refined embodiment of the steerable wheel of the embodiment of FIG. 13. In the FIG. 14 embodiment the pin 90 is a threaded pin which is screwed into a lug 94 provided on the axle 21 adjacent the point at which it merges into the first link 17. The pin also passes through a further lug 95 of the axle tube and is thus supported at two spaced apart locations in the axle tube 21. The end of the first link 18 is also provided with two spaced apart lugs 96 and 97 through which the pin 90 passes. Since the pin is doubly supported it can be made relatively slender without being liable to breakage. Thus the embodiment of FIG. 14 enables a particularly compact. arrangement to be realised. Once again the inclined axis 92 intersects the notional vertical axis 35 at the centre of the ground contact patch at 68.

Figure 20:
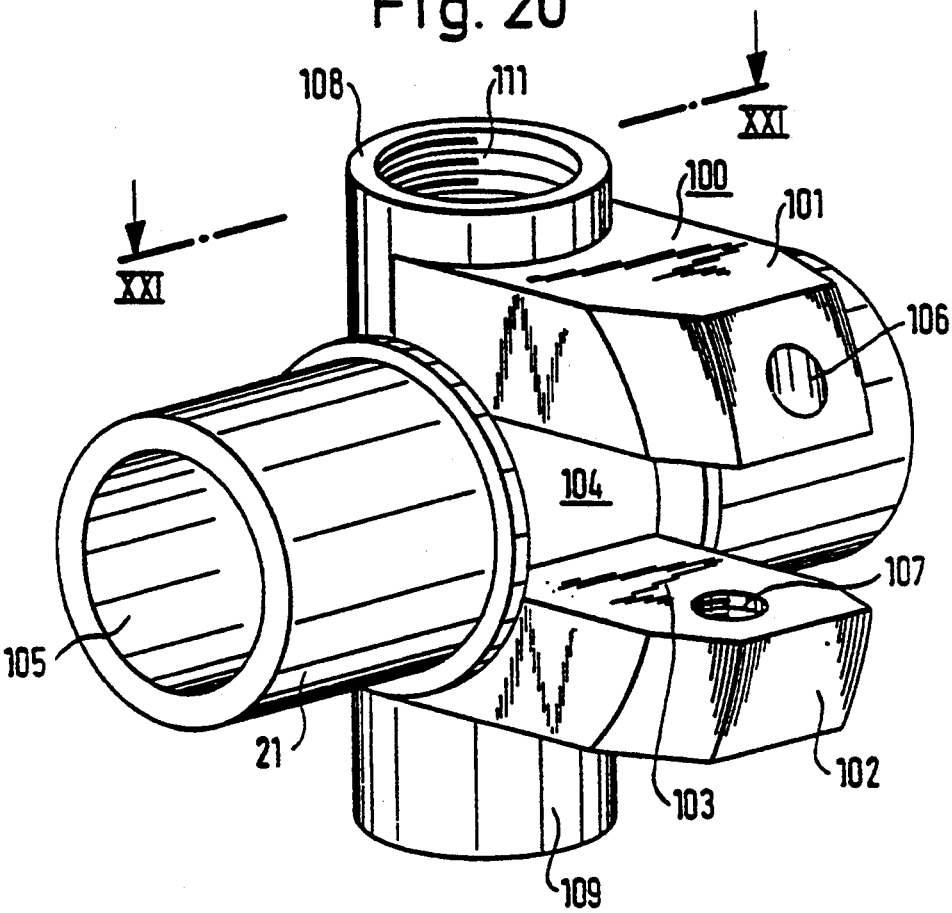
FIG. 20 a perspective view of an alternative axle tube configuration.

Turning now to FIG. 20 there is shown an alternative embodiment of the axle tube 21 in accordance with the present invention. This axle tube, or rather the complete axle assembly is also suitable for mounting in a chassis by an arrangement in which the ends of the axle shaft are supported directly by the chassis or indirectly via a single pivoted fork, e.g. in the form of a pair of trailing or leading arms. Also the axle shaft could be mounted on a chassis by a single link which is connected to one end of the axle shaft only and which could be mounted about a horizontal pivot axis at its other end, e.g. by a torsion bar, e.g. as a front and/or rear wheel of a motorbike. In this embodiment no further link means are used to connect the ends of the axle tube to the chassis. This is also fundamentally possible with the embodiments described earlier, particularly if the vertical axis is tilted in the vertical longitudinal plane of the chassis.

The axle tube 21 has a centrally disposed support portion 100 which in this embodiment is integrally formed with the material of the axle tube 21. The support portion 100 comprises two arms 101, 102 which project in a generally radial plane away from the axis of the axle tube 21. A space 103 is defined between the two arms 101, 102 and communicates via an opening 104 with the interior 105 of the axle tube. Formed in the arms 101, 102 at the ends thereof are threaded bores 106, 107 which accommodate gimbal pins for supporting the axle shaft in a manner which will later be described. In addition the support portion 100 has two radially directed cylindrical recesses 108, 109, that is to say recesses which are aligned on an axis radial to the central longitudinal axis of the axle tube 21 which serve to accommodate resilient spring elements in a manner which will be described later. It suffices to state here, that the recesses 108, 109 are threaded at their end portions, for example as shown at 111 in FIG. 20 to receive caps.

Figure 21:
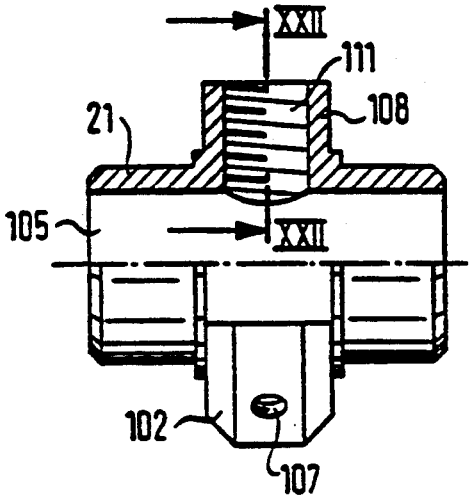
FIG. 21 a partly sectioned end view of the axle tube of FIG. 20, with the sectioned portion being taken in the plane XXI of FIG. 20, FIG. 22 a partly sectioned side view of the axle of FIG. 20 as seen in the direction XXII of FIG. 21, FIG. 23 a plan view of the axle shaft for the axle tube of FIG. 20, FIG. 24 a partly sectioned view of a yoke used with the axle shaft of FIG. 23, FIG. 25 a partly sectioned view of the yoke of FIG. 24 as seen in accordance with the arrow XXV of FIG. 24, FIG. 26 a side view of a pin used with the axle shaft and tube of FIGS. 20 to 25, FIG. 27 a sectional illustration of a rubber spring grommet used with the pin of FIG. 24, FIG. 28 a sectional view of a threaded cap for retaining the spring grommets of FIG. 27, FIG. 29 a cross-sectional view of a further axle assembly taken on the plane XXIX—XXIX of FIG. 30, FIG. 30 a partly sectioned plan view of the axle of FIG. 29 with the section being made on the plane XXX—XXX of FIG. 29, FIG. 31 a perspective view of yet another axle tube in accordance with the present invention, and FIG. 32 an end view of a yet further axle assembly formed within the inner race of a bearing, FIG. 33 a perspective view of a modified axle tube similar to FIG. 20, FIG. 34 a view of a cap which can be used with an axle tube in accordance with FIG. 20 or in accordance with FIG. 31 to achieve the same effect as is achieved with the axle tube of FIG. 33, FIG. 35 an end view of the cap of FIG. 34, FIG. 36 a schematic view of an alternative axle shown partly in cross-section and consisting of two parts, FIG. 37 a plan view of one half of a two-part axle tube similar to that of FIG. 36, FIG. 38 an end view of an axle shaft suitable for use with the embodiment of FIG. 36, FIG. 39 a schematic view of an alternative chassis arrangement, and FIG. 40 a modified version of the arrangement of FIG. 39.
Figure 22:
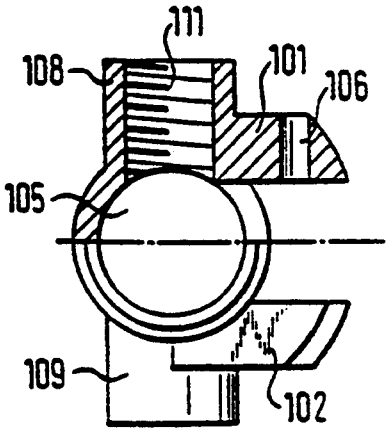

The precise shape of the axle tube of FIG. 20 can also be seen with reference to the partly sectioned illustrations of FIGS. 21 and 22. Although FIGS. 20, 21 and 22 show the axis formed by the gimbal pins as being substantially vertically directed, it will be understood that in the inbuilt position of the axle this axis subtends the angle $\alpha$ described previously in relation to FIG. 12.

Figure 23:
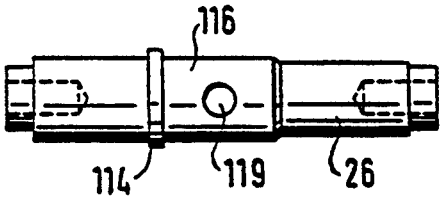

Turning now to FIG. 23 there can be seen a side view of the axle shaft used with the axle tube of FIGS. 20 to 22. The axle shaft 26 of FIG. 23 is in fact pressed into a bore 112 of a yoke member 113 and indeed until the collar 114 on the shaft 26 abuts against the shoulder 115 of the yoke 113. The bore 112 and the corresponding mating portion 116 of the axle 26 are preferably tapered fractionally, so that the conical surfaces ensure easy introduction of the axle shaft into the yoke and a tight fit. As can also be seen from FIG. 24 and from FIG. 25, the yoke 113 has a nose portion 116 which projects through the opening 104 of the axle tube 21 of FIGS. 20 to 22 into the space between the two arms 101 and 102. As also seen in FIG. 25 the nose 116 has two conical recesses 117, 118 which receive the points of the gimbal pins inserted through the bores 106, 107 of the embodiment of FIG. 20.

It will be appreciated from the foregoing disclosure that the yoke 113 must be inserted into the axle tube and between the arms 101 and 102 before the shaft 26 is pressed through the bore 112. The ends of the shaft 26 are formed in the same way as the ends of the shaft of FIGS. 4 and 5 and will not be described here in further detail.

Figure 24:
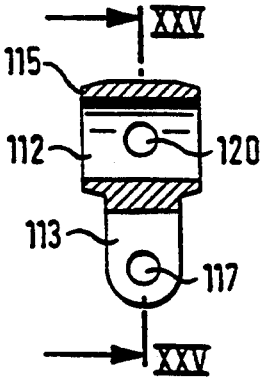
Figure 25:
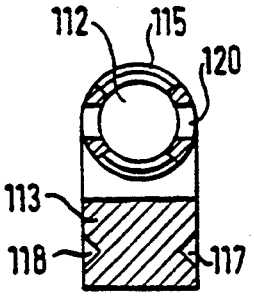
Figure 26:
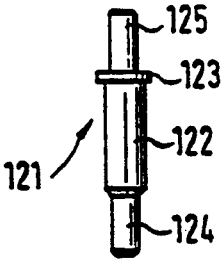
Figure 27:
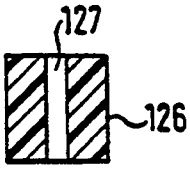
Figure 28:
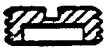

It will also be noted from FIGS. 23 and 24 that the shaft is provided with a transverse bore 119 with a corresponding transverse bore 120 being formed in the yoke 113. The purpose of these transverse bores 119 and 120 is to accept a shouldered pin 121 as shown in FIG. 26. The shouldered pin has a portion 122 which extends through the two bores 119 and 120, a shoulder or collar 123 which prevents the pin falling through two bores 120 and 119, i.e. provides a positive step limiting the movement of the shoulder pin, and two spigots 124 and 125 which after insertion of the pin project into the cylindrical recesses 108 and 109 of the axle tube. The portion 122 can be tapered. As can be seen these spigots 124, 125 are of substantially smaller diameter than the cylindrical recesses 108, 109 and are surrounded in operation by a cylindrical rubber grommet shown in longitudinal section in FIG. 27. As can be seen from FIG. 27 the rubber grommets have a plane-cylindrical outer surface 126 which fits in one of the bores 108 or 109 respectively and a plane cylindrical inner bore 127 which accommodates a respective one of the spigots 125 and 124. Any deflection of the axle shaft relative to the aligned position along the axis of the axle tube causes compression of the rubber grommets which thus generate a restoring force. The rubber grommets are secured in position by screw caps introduced into the threaded ends of the recesses, for example a threaded cap such as is shown in section in FIG. 28.

It will be appreciated that the shouldered pin is also inserted through the yoke 113 and the axle shaft 26 after the latter two components have been united in the axle tube. The shouldered pin has a double function in as much as it not only transmits the resetting force to the axle shaft but also secures the axle shaft within the yoke 113.

It will be appreciated that in use first and second bearings, typically ball bearings are pushed over the cylindrical shoulders of the axle tube on either side of the support portion 100. I.e. until the inner races of the bearings abut against the ring shoulders formed on and directly adjacent the support portion 100. Although not shown in the drawings means may be provided at the ends of the axle tube for securing the bearing inner races.

In a practical embodiment the axle tube and the yoke have been made of an aluminium alloy and the shaft of the steel alloy. To ensure a firm seat for the gimbal pins, which in the embodiment under discussion have conical points (although they could also have other shaped ends, for example hemispherical ends) the gimbal pins are not threaded directly into the aluminium alloy but rather into cylindrical steel inserts pressed into the aluminium alloy. In practice these inserts are shouldered cylindrical inserts or conical inserts which are pressed into the arms 101 and 102 from within the space 103, so that their shape prevents them from being pushed outwardly by the forces acting on the gimbal pin.

Figure 29:
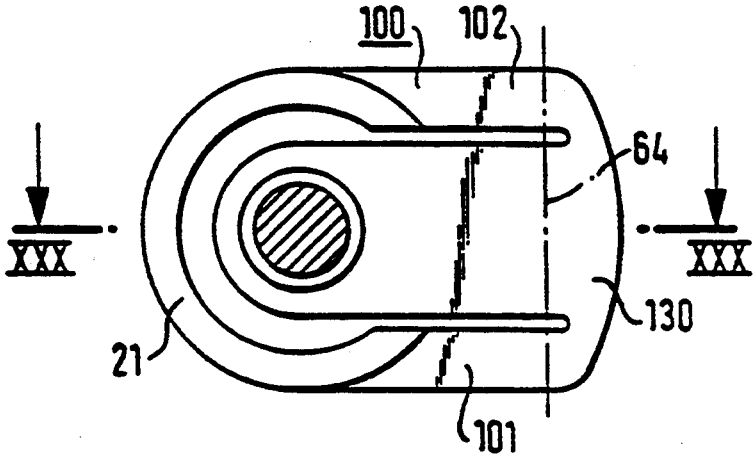
Figure 30:
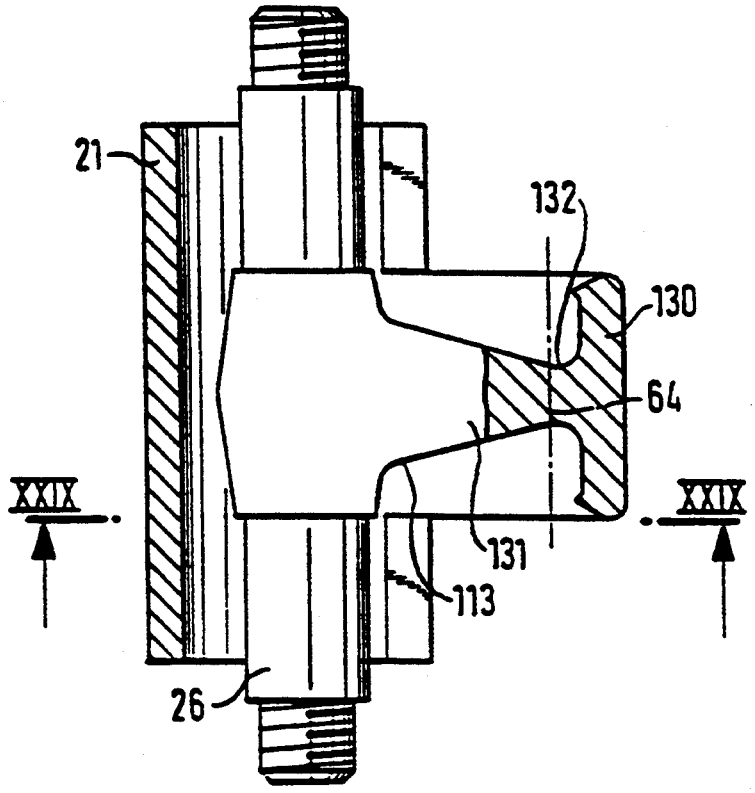

An alternative embodiment is shown in the FIGS. 29 and 30. The general shape of the axle assembly of FIGS. 29 and 30 is similar to that of the axle assembly of FIGS. 20 to 28 although the support portion 100 of this embodiment does not include cylindrical recesses such as 108 and 109 of the axle tube 21 of FIGS. 20 to 22.

In the embodiment of FIGS. 29 to 30 is preferably formed as an injection molding in a fibre reinforced plastic and has the special feature that the arms 101 and 102 are connected together by a bridge piece 130 which merges via a web 131 into the yoke 113 surrounding the axle shaft 26. The axle shaft is formed in this case of steel and is embedded in the yoke 113 during the injection molding thereof. Of particular interest in this embodiment is the fact that the web 131 has a narrowed portion at 132 which defines the axis 64 which permits limited relative pivotal deflection or steering movement between the axle shaft and the axle tube. In the embodiment shown this narrowed portion 132 extends over the full vertical depth of the web 131. Although this embodiment is preferred for a synthetic axle tube, it could also be realised in metal. It need not necessarily be made in one piece but could be assembled, for example the bridge piece 130 could be made in one piece with the yoke 131 and screwed to the ends of the arms 101, 102.

Figure 31:
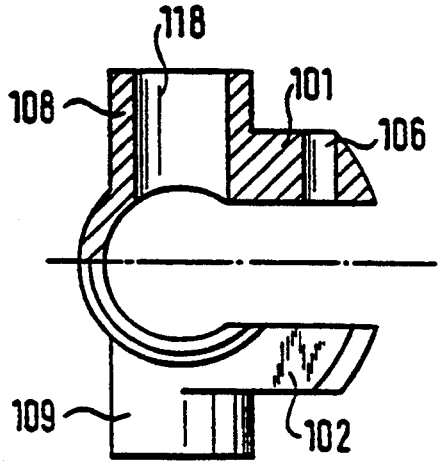

Another possibility for forming the axle assembly would be to make the axle tube of C-shaped section, i.e. with a continuous slot along its length as shown in FIG. 31. In FIG. 31 the C-section resembles the axle tube of the FIGS. 20 to 23, however the C-shaped cross-section of the axle tube is not restricted to this embodiment, it could also be used for example with the embodiment of FIGS. 29 to 30, and indeed irrespective of whether the axle tube is made there of one piece with a composite assembly. With such a C-shape the tube could be resiliently dilated to allow gimbals to be inserted between the yoke 113 and the arms 101, 102, e.g. gimbals in the form of ball bearings, thus simplifying the design. Indeed the gimbals could be an integral part of the yoke, or at least previously assembled therein.

Figure 32:
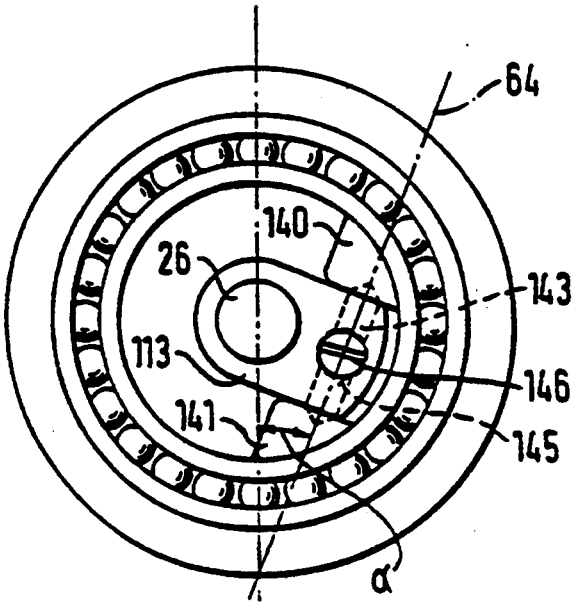

FIG. 32 shows another particularly important embodiment. Here the axle tube assembly is formed by the inner race of the bearing and this inner race is provided with noses 140, 141 which are spaced apart to receive the nose of a yoke 113 fashioned similarly to the yoke 113 of FIG. 24. As can be seen from FIG. 32 the two gimbal pins are axially displaceable in a bore 143 in the yoke 113 and indeed the yoke 113 also has a transverse bore 145 which accommodates a securing pin 146, for example a threaded pin. For assembly of the axle the threaded pin 146 is removed and the gimbal pins are pressed into the nose until they are flush with its surface. The nose of the yoke 113 can then be inserted between the two noses of the inner race of the bearing and thereafter the pin 146 inserted in order to force the gimbal pins outwards into their bearing seats in the noses of the inner race. An arrangement of this kind is necessary since the nose of the yoke 113 should be a fairly close fit within the space between the noses of the inner race of the bearing so as to ensure a sound fit and adequate bearing surface for supporting the nose of the yoke for pivotal movements about the axis 64 defined by the gimbal pins.

A thrust bearing, indeed even a roller thrust bearing could also be inserted in the above described axle embodiments between the yoke and the axle tube to ensure the thrust loads arising in operation are adequately borne. The yoke 113 can also be formed integrally with the axle shaft 26.

Figure 33:
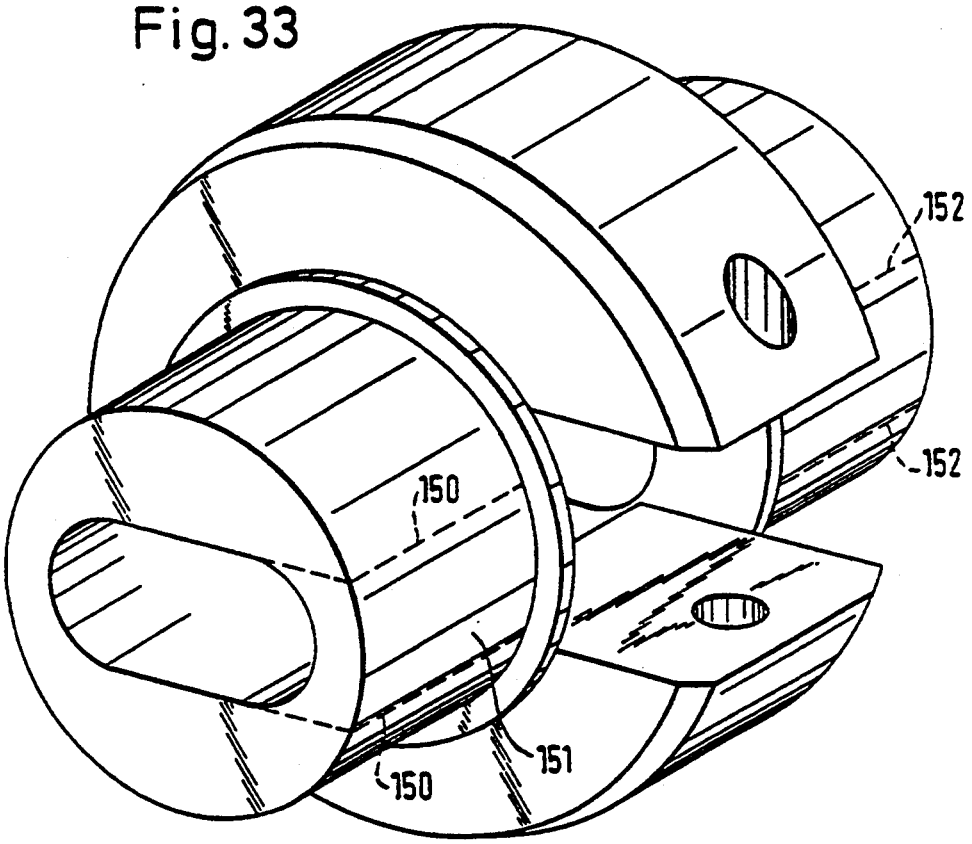

Turning now to FIG. 33 there can be seen an axle tube having substantially the form of the axle tube of FIG. 20 however the interior 105 of the axle tube is formed so that it has the shape of an elongate slot in cross-section, at least at the ends of the axle tubes. The axle tube could also be C-shaped in cross-section which is indicated by the broken lines 150, i.e. the portion 151 between the broken lines 150 would be omitted. This modification would of course also be made at the other end of the axle tube as is likewise indicated by broken lines 152. It will be noted that the axle tube of FIG. 33 does not include the cylindrical portions 108, 109 of the FIG. 20 embodiment. However these portions could also be provided if desired.

The purpose of the elongate slot-like cross-sectional shape of the interior opening 105 of the axle tube of FIG. 33 is to provide additional bearing surface for supporting the axle shaft at its ends.

Figure 35:
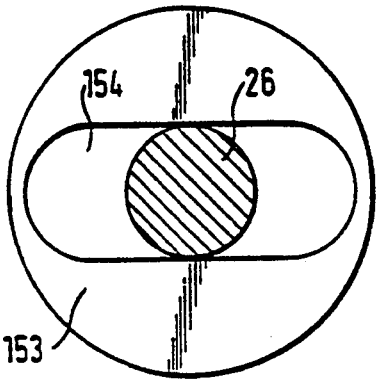
Figure 34:
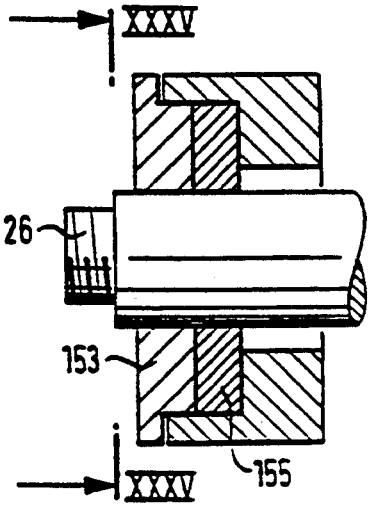

This arrangement can also be realised in an axle tube in accordance with FIG. 20 or in an axle tube in accordance with FIG. 31 by the use of caps 153 as shown in FIGS. 34 and 35. That is to say the caps have an elongate slot-like opening 154 corresponding to the shape of the elongate cross-sectional opening 105 of FIG. 33 whereas the opening of the axle tube is otherwise of generally cylindrical shape. The caps can be press-fitted into or onto the ends of the axle tube and can also be bonded thereto by means of adhesive, or welded thereto. They can also carry resilient elements, such as the rubber washer 155 shown in FIG. 34, in order to generate the restoring or self-centering moment on the axle shaft. The washer 155 could for example have a circular opening corresponding to the diameter of the axle shaft, rather than an elongate slot-like opening, so that deflection of the ends of the axle 26 about the axis defined by the gimbals causes compression of the rubber washer. Although in the present embodiment the axle shaft is supported by the caps primarily at its ends it is also possible for the axle shaft to be supported throughout its length within the axle tube by corresponding bearing surfaces. Moreover the axle shaft can have flats at its two surfaces adjacent the bearing surfaces so that the bearing loads are reduced. With an arrangement of this kind the gimbal pins merely define a pivot axis and the loads on the axle are primarily borne by the bearing surfaces.

Figure 36:
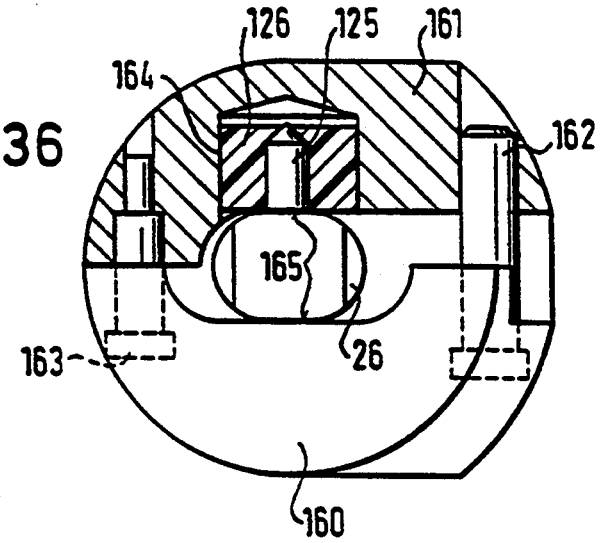
Figure 37:
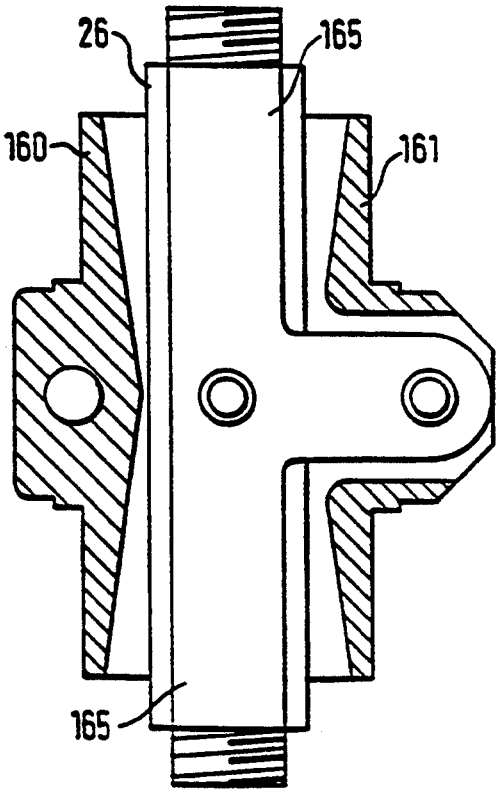

As shown in FIG. 36 the axle tube can also be formed in two parts 160 and 161, with these two parts being shaped in mirror-image fashion and being secured together by threaded fasteners, for example the threaded fasteners 162 and 163. The formation of the axle tube in two at least substantially identical halves reduces the manufacturing costs. Moreover, cylindrical recesses such as 164 can also be provided to accommodate rubber grommets 126 corresponding to the rubber grommets used in the FIG. 20 embodiment. If this is done then the axle 26 of FIG. 38, which is provided with pins such as 125 and 124 in FIG. 26, will be restored to its straight head running position by the resilient action of the grommets 126. An alternative to joining the two halves of the axle housing together by threaded fasteners is shown in FIG. 37. Here the axle tube comprises a tough plastic material, it is again made in two halves (the lower half 160 being shown in FIG. 37) and the two halves are bonded together by an adhesive, or by ultrasonic welding at the mating faces such as 161, optionally after insertion of the axle shaft 26. The FIG. 37 embodiment shows the axle shaft 26 in plan view, the latter being provided with flats 165 at its surfaces which rest on the bearing surfaces defined by the two halves of the axle tube.

Figure 38:
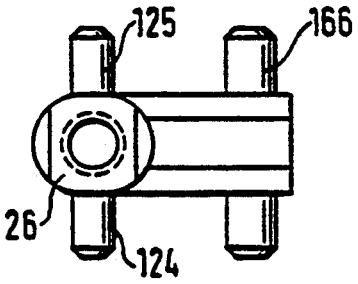

With an arrangement as shown in FIG. 36 and FIG. 37 the axle shaft 26 can conveniently have the shape shown in end view in FIG. 38. That is to say the gimbal pins can be formed by a throughgoing cylindrical pin 166 which may be a shouldered pin. The two cylindrical ends of the pin 166 can be inserted into corresponding cylindrical bearing bores of the two parts of the axle tube prior to assembly of these two parts of the axle tube.

The following comments can thus be made relating to the embodiments of FIGS. 33 to 38.

This embodiment makes it possible for the axle tube to be so executed that the main load pick-up for the axle shaft does not take place at the tips or spherical ends of the gimbal pins but rather at the sides of .the axle shaft where it emerges from the axle housing, the axle shaft being made in particular of steel. In the one embodiment a cap having a guide and support cut-out (slot) is fixedly anchored in the opening of the axle tube from both sides (for example by a toothed, bonded, or welded fit or the like). The slot has the width of the axle shaft diameter in the vertical direction so that the axle can move slidingly. In the horizontal direction the slot is so shaped that the axle can make just the same steering movement as it would make without the cap. It is however also possible to restrict the freedom of movement of the axle horizontally by the cap, which can, if desired, be done at one side only.

In the event of a separate cap this can be executed as an accessory or a replacement part for retrospective insertion or for repair purposes by the user. The cap can be so executed that it reinforces the axle tube, in particular when the axle tube is of C-shape or consists of a tough plastic material. The caps likewise reinforce the axle shaft, at least in the sense that they relieve the axle shaft of substantial bending loads.

The caps can also be so executed that they have a spring element of rubber, resilient plastic or of spring steel at their rear side which returns the axle into the zero position and acts in a shock-absorbing manner. Different spring strengths can be provided to match different body weights and performances. By displacing the springing into the outer regions of the axle the spring element around the central pin of the inner shaft can, if desired, be omitted, whereby the special shaping of the housing in this region can also be omitted and simple tools can be used to manufacture the housing or axle tube. In individual cases optimisation will be effected relating to the loadability of the axle and its manufacturing cost, depending on the particular application. It is also conceivable that the axle tube can be made in C-shape, the center of the C forming the above described guide and support slot. Such a one piece axle tube would have an opening for the insertion of the axle which can be provided at the front or at the rear. It makes it possible to insert the preassembled internal axle or axle shaft. This axle shaft can for example be forged in one piece if the springing is displaced to the ends of the axle tube. Since the tools are somewhat more complicated and expensive an embodiment of this kind may only be practicable from a cost point of view when large numbers of axles are being manufactured. When used as self-steering systems for larger vehicles, as roller skates or roller skis, the guide support for the axle ends can also be made using known ball, roller or sliding bearings. Depending on the application the central suspension of the axle shaft can then be relieved and the cost of the total construction can be optimised.

It will be appreciated that the above described axle assemblies are particularly suited for use in in-line skates, e.g. (without restriction) in three wheel in-line skates in which the centre wheel is a plain wheel on a fixed axle and the two outer end wheels have axle assemblies as described herein with the axle assemblies being reversed (e.g. as in FIG. 1) so that the steering axes of the wheels are inclined at the same angle to the vertical direction but are positioned on opposite sides of the vertical direction.

Figure 39:
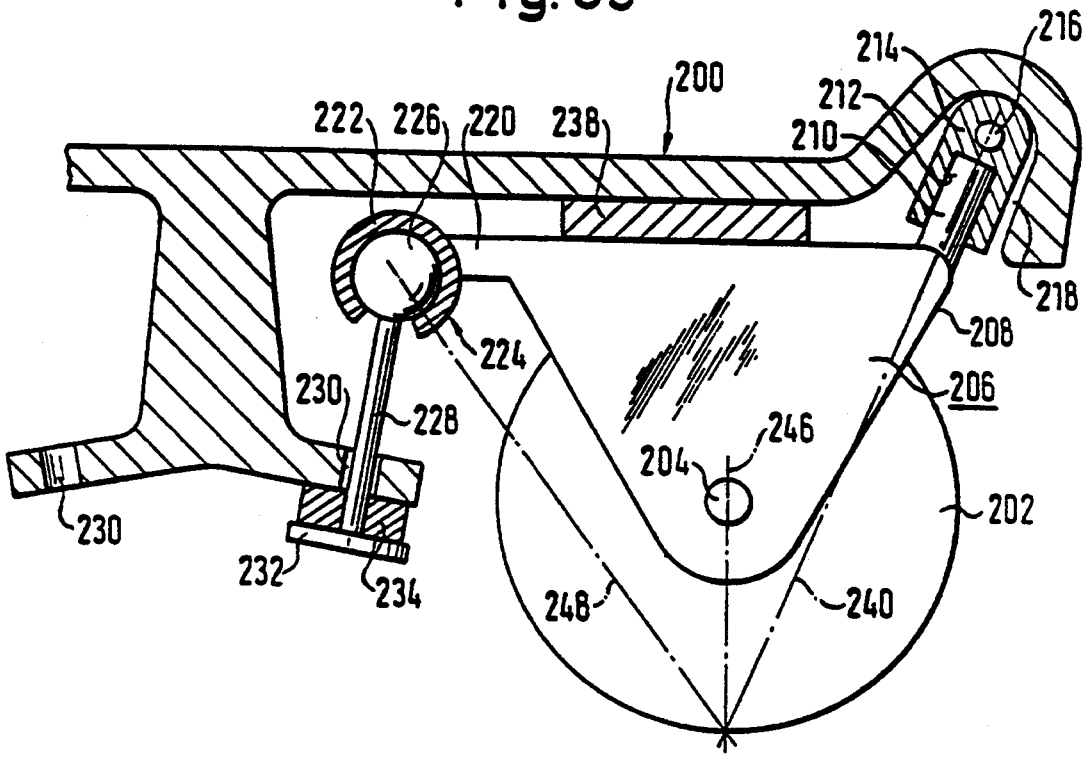
Figure 40:
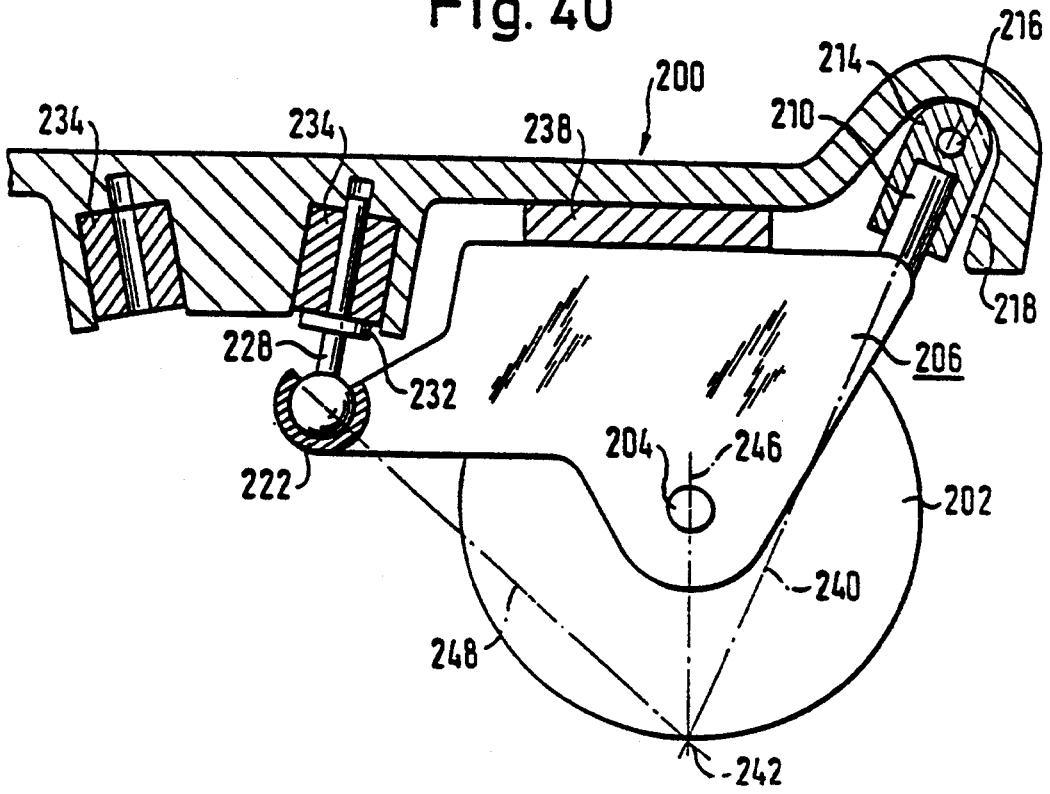

Finally, a further compact version of a chassis arrangement is shown in FIG. 39 with a further modification being shown in FIG. 40. In the embodiment of FIG. 39 the chassis is indicated generally by the reference numeral 200. The chassis supports a wheel element 202 which is connected via an axle 204 to a saddle-shaped yoke 206 which straddles the wheel. That is to say the axle 204, which is a straightforward axle directly supporting the wheel via one or more bearings, is rigidly connected to the yoke 206. The rear end of the yoke 206 is formed as a link 208 having a spigot 210 which engages in a cylindrical bearing recess 212 in a generally cylindrical bearing member 214. The cylindrical bearing member 214 is mounted on a horizontal transverse axle 216 within a bell-shaped recess 218 in the chassis 200. The front end of the saddle 206 forms a second link 220 which is connected to the cup 222 of a spherical joint 224. The ball 226 of this spherical joint is connected by a generally vertical link 228 to the chassis 200 with the vertical link 228 passing through an opening 230 in the chassis with clearance and having a head portion 232 which traps a rubber bush 234 between itself and the chassis 200. The role of the spherical cup 224 and the spherical ball 224 can also be reversed, i.e. the second link can connect with the ball and the cap can be mounted on the vertical link 228.

An inverse arrangement is possible as shown in FIG. 40 in which the vertical link 228 is disposed so that the spherical joint 222 is disposed beneath the chassis 200 in which case the resilient bush 234 is mounted above the head 232 of the link between the head of the link and the chassis 200. The spigot portion 236 of the vertical link 228 serves for general location of the vertical link 228 within the chassis. Additional resilience permitting springing of the wheel in the vertical direction can be provided by a resilient cushion 238, for example of foam rubber, inserted between the yoke 206 and the chassis 200. Again two such wheels can be mounted in opposition on a chassis in the manner illustrated with respect to FIG. 1. It will be noted that the spigot defines a first pivot axis 240 which passes through the ground contact patch 242, that the axle and the ground contact patch define a notional vertical axis 246 and that the spherical joint in ground contact patch define a further notional axis 248 with the wheel being constrained by the geometrical arrangements to move around these axes under the influence of the weight applied to the wheel and the prevailing tilting forces which depend on the direction in which the user wishes to steer.

In FIGS. 39 and 40 only the rear wheels are shown, the front wheels are of similar design but are reversed as in FIG. 1, this is indicated by the illustration of the mountings for the links 228 for the front wheels.

I claim:

1. A chassis arrangement comprising:

a chassis having a steering by tilting assembly which includes a pair of steering link members, an axle assembly including an axle shaft and a hollow axle tube, a steerable wheel and at least one bearing mounting the wheel on the hollow axle tube, means for connecting the axle shaft to said link members, said axle shaft being at least partially disposed within said axle tube, and means, extending between said axle tube and said axle shaft and defining an axis, permitting limited relative steering movement between said axle shaft and said axle tube, said axis being an inclined axis and disposed in a vertical plane including a normal straight ahead direction of said steerable wheel and being directed so that the axis points through a region of contact between said steerable wheel and the ground.

2. A chassis arrangement in accordance with claim 1, further comprising:

resilient means provided between said axle tube and said axle shaft.

3. A chassis arrangement in accordance with claim 1, wherein:

the axle shaft of said axle assembly is mounted rigidly to said chassis.

4. A chassis arrangement in accordance with claim 1, wherein: said axis has a notional point of intersection with said contact region which is disposed in a front and a center of said contact region, at least when said steerable wheel is in a non-worn state.

5. A chassis arrangement in accordance with claim 1, characterised in that said axle tube comprises an inner race of said bearing.

6. A chassis arrangement in accordance with claim 1, wherein:

the hollow axle tube has a centrally located support portion, said support portion having first and second spaced apart arms extending in a generally radial plane away from said axle tube, a space between said first and second arms communicating with an opening in a sidewall of said axle tube;

a nose formed on said axle shaft and projects through said opening between said arms; and said means extending between said axle tube and said axle shaft comprises means for coupling said support portion to said nose.

7. A chassis arrangement in accordance with claim 6, wherein:

said means extending from said arms to said yoke comprises gimbal pins provided in said first and second arms, said gimbal pins having bearing elements at ends thereof which engage complementary shaped recesses in said nose.

8. A chassis arrangement in accordance with claim 6, wherein:

said axle tube and said nose comprise an aluminum alloy;

said axle shaft being pressed into a corresponding bore formed in said nose; and said gimbal pins being arranged in threaded tube elements pressed into said first and second arms, the threaded tube elements having longitudinal axes corresponding with said axis.

9. A chassis arrangement in accordance with claim 6, characterised in that said arms are joined together at their ends spaced apart from said openings by a bridge piece; in that said yoke is connected by a web to said bridge piece and in that said means defining said axis permitting limited relative pivotal deflection or steering movement is formed by said web or by said bridge piece.

10. A chassis arrangement in accordance with claim 9, characterised in that said axle tube, said bridge piece, said web and said yoke are formed as a unitary component.

11. A chassis arrangement in accordance with claim 10, characterised in that said unitary component is formed of a plastic material, preferably a fibre reinforced plastic material.

12. A steerable element in accordance with claim 10, characterised in that said plastic material is formed by injection molding and is in particular injection molded around a metal component forming said axle shaft.

13. A chassis arrangement in accordance claim 10, characterised in that said means defining said axis is formed by a portion of said web disposed adjacent said bridge piece and being of reduced thickness relative to the remainder of said web.

14. A chassis arrangement in accordance with claim 6, characterised in that said opening extends over the full length of said axle tube which is thus approximately of C-shape in cross-section.

15. A chassis arrangement in accordance with claim 6, characterised in that a pin member is inserted through said yoke and said axle shaft and projects at both ends beyond said yoke and said axle shaft into approximately cylindrical recesses provided in said axle tube, with said pin member having a substantially smaller diameter than said recesses; and in that resilient spring members are inserted into said recesses surrounding said ends of said pin member.

16. A chassis arrangement in accordance with claim 15, characterised in that said resilient members comprise rubber or rubber-like grommets.

17. A chassis arrangement in accordance with claim 16, characterised in that said resilient members are insertable into said recesses from the outside of said axle and are retained therein by caps, in particular threaded caps inserted into the radially outer ends of said recesses.

18. A chassis arrangement in accordance with claim 6, characterised in that said axle tube projects at both ends beyond said support portion and forms cylindrical or part-cylindrical bearing surfaces for receiving the inner races of rolling element bearings; and in that a tire is mountable on the outer races of said bearings.

19. A chassis arrangement in accordance with claim 6 wherein: said support portion is integrally formed with said axle tube.

20. A chassis arrangement in accordance with claim 6, further comprising:

rolling element bearings comprising an inner race and an outer race;

said axle tube projecting beyond said support portion at first and second ends and forming at least part-cylindrical bearing surfaces for receiving the inner race of the rolling element bearings, said axle tube also including slots formed on a side of the opening; and a tire mounted on the outer race of said rolling element bearings, said inner race of said rolling element bearings having a nose which enters into the slots.

21. A chassis arrangement in accordance with claim 1, characterised in that said axle tube comprises an inner race of a single bearing, said inner race having at least one internally disposed nose, preferably two such spaced apart noses forming supports for gimbal pins provided on a yoke or nose of said axle shaft projecting into a space between said inner race and said internally disposed nose, or between said spaced apart noses.

22. A chassis arrangement in accordance with claim 21, characterised in that means is provided in said yoke for biasing said gimbal pins from a first position in which their tips are substantially parallel to the surface of said yoke into an operative position in which their tips engage in corresponding recesses formed in said inner race of said bearing, i.e. in said internally disposed nose, and said inner race or in said spaced apart noses.

23. A chassis arrangement in accordance with claim 1, chararacterised in that said axle tube is shaped or provided with end caps to form bearing surfaces for supporting said axle shaft to permit pivotal movement about said axis permitting limited relative pivotal deflection or steering movement but restraining movement and deflection of said axle shaft relative to said axle tube in other directions.

24. A chassis arrangement in accordance with claim 23, characterised in that a cap is provided at each end of said axle tube, each said cap being fitted to the respective end of said axle tube, e.g. by being screwed thereto or press-fitted therein and/or press-fitted thereover, optionally with shoulder means locating each said cap axially relative to said tube, and with each said cap having an elongate opening having a height substantially equal to the height of said axle shaft as it passes through said opening and a length sufficiently large to permit said limited pivotal deflection or steering movement of said axle shaft about said axis.

25. A chassis arrangement in accordance with claim 23, characterised in that at least one of said caps is provided with resilient means at an end face thereof, e.g. a resilient means in the form of a rubber disc or grommet or a steel spring.

26. A chassis arrangement in accordance with claim 1, characterised in that said axle tube comprises first and second similarly shaped and preferably identically shaped parts, e.g. mirror image parts, which are joined together, e.g. by welding, by adhesives or by fastener means, to form the finished axle tube; and in that said first and second parts preferably comprise essentially C-shaped parts having recesses for receiving resilient bushes for exerting a restoring self-centering force on said axle shaft; and in that said first and second parts preferably define extensive bearing surfaces for supporting said axle shaft during movement about said axis, with said first and second parts preferably being united together around said axle shaft.

27. A chassis arrangement in accordance with claim 26, wherein:

said axle tube comprises first and second similarly shaped parts, said first and second parts defining bearing surfaces for supporting said axle shaft during pivotal movement about said axis; and the axle shaft including flats at surfaces which rest on the bearing surfaces defined by the first and second parts of said axle tube.

28. A chassis arrangement in accordance with claim 27 wherein: said first and second parts have substantially the same shape.

29. A chassis arrangement in accordance with claim 27 wherein: said first and second parts of said axle tube are joined together by welding.

30. A chassis arrangement in accordance with claim 27 wherein: said first and second parts of said axle tube are joined together by an adhesive bond.

31. A chassis arrangement in accordance with claim 27 wherein: further comprising means for fastening said first and second parts together.

32. A chassis arrangement in accordance with claim 27 wherein: said first and second parts comprise essentially C-shaped parts, said C-shaped parts being coupled together around said axle shaft.

33. A chassis arrangement in accordance with claim 32 wherein: said C-shaped parts have recesses for receiving resilient bushes for exerting a restoring, self-centering force on said axle shaft.

34. A chassis arrangement in accordance with claim 26 characterise in that said axle shaft comprises two cylindrical gimbal pins which can be inserted into corresponding cylindrical bearing bores of said first and second parts of said axle tube prior to assembly of said axle tube.

35. A chassis arrangement in accordance with claim 26, characterised in that said axle shaft is provided with further pins which engage in resilient bushes provided in said recesses of said essentially C-shaped parts.

36. A chassis arrangement in accordance with claim 1, characterised in that said steerable element is built into the chassis with said axis permitting limited relative pivotal deflection of steering movement between said axle and said axle tube being directed at an angle of substantially 25° to the vertical.

37. A chassis arrangement in accordance with claim 1, characterised in that it is used in an in-line skate having first and second steerable end wheels each mounted on a respective axle assembly, with said axle assemblies being reversed so that the steering axes of the wheels are inclined at the same angle to the vertical direction but are positioned on opposite sides of the vertical direction.

38. A chassis arrangement in accordance with claim 37, characterised in that a third wheel is provided between said two wheels to form a three wheel chassis with said third wheel being a non-steerable wheel.

39. A chassis arrangement in accordance with claim 1 wherein: the connecting means comprises a fork.

40. A chassis arrangement in accordance with claim 39 wherein: the fork is pivotally mounted to said chassis.

41. A chassis arrangement in accordance with claim 39 wherein: the fork is configured as a leading fork suspension.

42. A chassis arrangement in accordance with claim 39 wherein: the fork is configured as a trailing fork suspension.

43. A chassis arrangement in accordance with claim 39 further comprising: spring means acting between a fixed part of the chassis and the fork.

44. A chassis arrangement in accordance with claim 1 wherein: said axle shaft is supported at an end by the connecting means.

45. A chassis arrangement in accordance with claim 1 wherein: said connecting means comprises a post connecting an end of said axle shaft to said chassis.

46. A chassis arrangement in accordance with claim 7 wherein: said bearing elements comprise bearing points.

47. A chassis arrangement in accordance with claim 46 wherein: said bearing elements comprise ball-shaped elements.

48. A chassis arrangement in accordance with claim 8 wherein: said corresponding bore formed in said nose comprises a tapered bore.

49. A chassis arrangement comprising:

a chassis having a steering by tilting assembly which includes a pair of steering link members;

an axle assembly having an axle shaft and a hollow axle tube, said axle shaft being at least partially disposed within said axle tube;

a rotatable wheel and at least one bearing mounting the wheel on the axle assembly, the wheel defining a vertical datum and a vertical plane when the wheel is in a normal straight ahead direction, the wheel also having an outer surface and a ground engaging contact region;

the axle tube being at least partially disposed within an area defined by the outer surface of the wheel;

means for connecting the axle shaft to said link members; and means for pivotally coupling the axle tube to the axle shaft so that the axle tube pivots with respect to the axle shaft about an axis, said axis being inclined with respect to the vertical datum and being disposed in the vertical plane of said wheel, the axis also being directed through the contact region of said wheel.

50. A chassis arrangement comprising:

a chassis having a steering by tilting assembly which includes a pair of steering link members;

an axle assembly having an axle shaft and an axle guide, the axle shaft having a first end and a second end and the axle guide having a first opening and a second opening, the first and second ends being disposed within the first and second openings, respectively, and the first and second openings being sized larger than the first and second ends thereby providing relative steering movement between said axle shaft and said axle guide;

a steerable wheel mounted via at least one bearing on the axle guide;

means for connecting the axle shaft to said link members; and means for pivotally coupling the axle guide to the axle shaft so that the axle shaft pivots with respect to the axle guide about an axis, said axis being inclined and directed through a region of contact between said steerable wheel and the ground.

* * * * *